United States Patent [19]

Fujiwara et al.

[11] Patent Number: 4,997,352

[45] Date of Patent: Mar. 5, 1991

[54] ROTARY FLUID COMPRESSOR HAVING A SPIRAL BLADE WITH AN ENLARGING SECTION

[75] Inventors: Takayoshi Fujiwara, Kawasaki; Hisanori Honma; Yoshinori Sone, both of Yokohama, all of Japan

[73] Assignee: Kabushiki Kaisha Toshiba, Kawasaki, Japan

[21] Appl. No.: 469,373

[22] Filed: Jan. 24, 1990

[30] Foreign Application Priority Data

Jan. 30, 1989 [JP] Japan ..... 1-20216
Jan. 31, 1989 [JP] Japan ..... 1-19639
Jan. 31, 1989 [JP] Japan ..... 1-19640

[51] Int. Cl.[5] ..... F04C 18/22

[52] U.S. Cl. ..... 418/164; 418/183; 418/220

[58] Field of Search ..... 418/55.1, 153, 156, 418/164, 172, 183, 220; 417/356

[56] References Cited

U.S. PATENT DOCUMENTS 1,295,068 2/1919 Rolkerr ..... 418/220
1,572,738 2/1926 Maroger .
2,397,139 3/1946 Heaton ..... 418/156
2,401,189 5/1946 Quiroz .
2,527,536 10/1950 Engberg ..... 418/153
3,274,944 9/1966 Parsons .
4,871,304 10/1989 Iida et al. ..... 418/220
4,872,820 10/1989 Iida et al. ..... 418/220
4,875,842 10/1989 Iida et al. ..... 418/220

FOREIGN PATENT DOCUMENTS 301273 1/1989 European Pat. Off. .
64-36990 2/1989 Japan .

OTHER PUBLICATIONS

European Search Report, EP 90101528.9, Aug. 16, 1990.

*Primary Examiner*—John J. Vrablik
*Attorney, Agent, or Firm*—Cushman, Darby & Cushman

[57] ABSTRACT

A fluid compressor includes a rotating body arranged in a cylinder to extend in the axial direction of the cylinder and eccentric thereto. A spiral groove is formed on the outer circumference of the rotating body, and a spiral blade is slidably fitted in the groove. The pitches of the groove is narrowed at a predetermined rate with a distance from a suction-side end of the cylinder to a discharge-side end of the cylider. The groove has an enlarging section which has a start point, a changeover point, and a terminal point. The enlarging section includes a first portion extending from the start point to the changeover point and having a pitch which changes at a rate smaller than the predetermined rate, and a second portion extending from the changeover point to the terminal point and having a pitch which changes at a rate larger than the predetermined rate. The space between the rotating body and the cylinder is divided by the blade into a plurality of operation chambers.

10 Claims, 5 Drawing Sheets

ROTARY FLUID COMPRESSOR HAVING A SPIRAL BLADE WITH AN ENLARGING SECTION

BACKGROUND OF THE INVENTION

1. Field of the Invention

The present invention relates to a fluid compressor for compressing refrigerant gas in a refrigerating cycle, for example.

2. Description of the Related Art

There have been well known compressors of various types such as those of the reciprocating and rotary types. In these compressors, however, the compression section and driving parts, such as the crank-shaft for transmitting a rotary force to the compression section, are complicated in construction so that consequently a large number of components must be used. Further, in these conventional compressors, it is required that a check valve be arranged on the discharge side thereof to enhance compression efficiency. However, the pressure difference on both sides of the check valve is quite large, thereby causing a gas leakage through the check valve. This lowers the compression efficiency appreciably. In order to solve this problem, it is required that the dimensions and assembly of parts used be highly accurate. As the result, the cost for manufacturing the compressor is very high.

U.S. Pat. No. 2,402,189 discloses a screw pump having a columnar rotating body provided with suction- and discharge-side ends. The rotating body is arranged in a sleeve, and a spiral groove is formed on the outer circumference of the rotating body. A spiral blade is slidably fitted into the groove. When the rotating body is rotated, fluid, which is introduced into a space between the outer circumference of the rotating body and the inner circumference of the sleeve and is confined between two adjacent turns of the blade, is transferred from one end of the sleeve to the other end. In short, the screw pump serves only to transfer the fluid from one end of the sleeve to the other end, and is not adapted to compress it.

In the above-mentioned screw pump, the volume of fluid transferred is proportional to the pitches of the spiral groove and blade. When the pitches of the groove and blade are large, therefore, the volume of fluid than can be transferred by the pump is large. In this case, however, the dimensions of the rotating body, sleeve and the like become larger as the pitches of the groove and blade increase. As a result, the whole pump becomes large and burdensome.

SUMMARY OF THE INVENTION

The present invention is therefore intended to eliminate the above-mentioned drawbacks, and its object is to provide a compact fluid compressor relatively simpler in construction, able to compress a larger volume of fluid, and capable of sealing and compressing fluid with higher efficiency.

In order to achieve the above object, according to the present invention, a fluid compressor comprises a cylinder having a suction-side end and a discharge-side end; a columnar rotating body arranged in the cylinder so as to extend in the axial direction thereof, and rotatable relative to the cylinder while part of the rotating body is in contact with the inner circumference of the cylinder, said rotating body having a spiral groove formed on the outer circumference thereof, said groove having pitches narrowed at a predetermined rate with a distance from the suction-side end of the cylinder to the discharge-side end and having an enlarging section provided with start, changeover and terminal points, and said enlarging section having a first portion extending from the start point to the changeover point and whose pitch changes at a rate smaller than said predetermined rate, and a second portion extending from the changeover point to the terminal point and whose pitch changes at a rate larger than said predetermined rate; a spiral blade fitted in the groove to be slidable in the radial direction of the cylinder, having an outer circumference close contact with the inner circumference of the cylinder, and dividing the space between the inner circumference of the cylinder and the outer circumference of the rotating body into plural operation chambers; and drive means for relatively rotating the cylinder and the rotating body, thereby introducing a fluid into the cylinder from the suction-side end thereof, transporting this fluid toward the discharge-side end of the cylinder through the operating chambers, and discharging the fluid outside through the discharge-side end of the cylinder.

According to the fluid compressor of the present invention having the above-described arrangement, the groove on the rotating body is formed in such a manner that its pitches are narrowed at a predetermined rate with a distance from the suction-side end of the cylinder. Therefore, fluid can be efficiently compressed without using a check valve and the like, by transporting the fluid from the suction-side end to the discharge-side end of the cylinder through the operation chambers.

Further, the groove has an enlarging section. The fluid feeding capacity of the compressor can be made larger as compared with those compressors in which the pitches of the groove are narrowed at a certain rate. A compressor having a larger capacity can be thus realized without making the compressor over-sized.

BRIEF DESCRIPTION OF THE DRAWINGS

FIGS. 1 through 11D show an embodiment of a fluid compressor according to the present invention, in which FIG. 1 is a sectional view showing the whole of the fluid compressor, FIG. 2 is a side view showing a rotating rod, FIG. 3 is a side view showing a blade, FIG. 4 is a sectional view showing a compressing section of the fluid compressor, FIG. 5 is a sectional view taken along the line V—V in FIG. 4, FIG. 6 is a plan showing the rotating rod, explaining the shape of a spiral groove, FIG. 7 is a side view showing the rotating rod with being partly cut away, FIG. 8 is a graph showing a relation between the spiral groove and the volume of operation chambers, FIGS. 11A through 11D are sectional views showing the position of the rotating rod relative to the cylinder in the gas compressing processes;

DETAILED DESCRIPTION OF THE PREFERRED EMBODIMENTS

Embodiments of the present invention will be described in detail with reference to the accompanying drawings.

Figure 1:
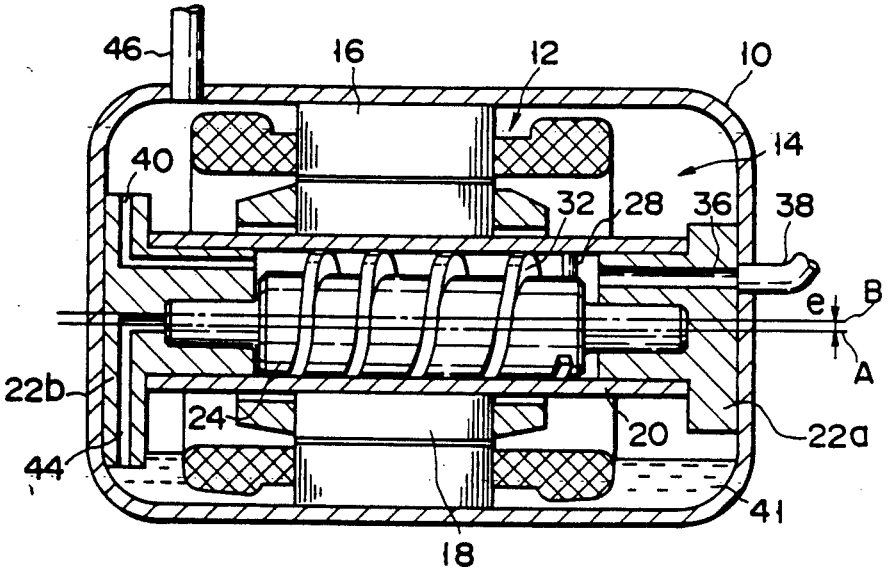

FIG. 1 shows an embodiment wherein the present invention is applied to a closed type compressor for compressing a refrigerant of a refrigeration cycle.

The compressor includes a closed case 10, an electric motor section 12, and a compression section 14, these section being housed in the case 10. The motor section 12 includes a ring-shaped stator 16 fixed to the inner face of the case 10, and a ring-shaped rotor 18 arranged inside the stator.

Figure 4:
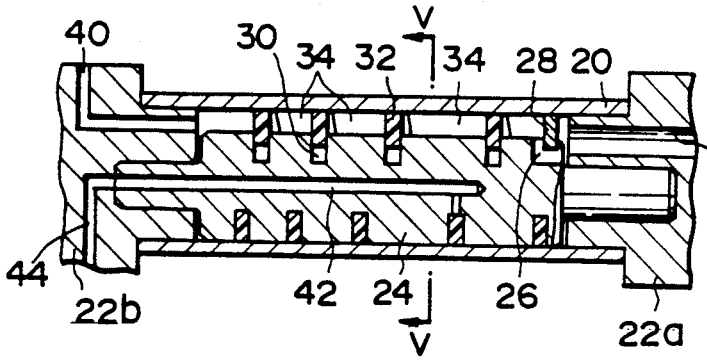
Figure 5:
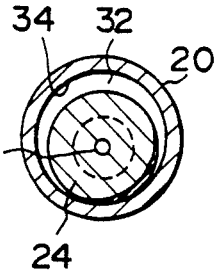

As shown in FIGS. 1 and 4, the compression section 14 includes a cylinder 20, and the rotor 18 is coaxially fixed to the outer circumference of the cylinder. The both ends of the cylinder 20 are closed and rotatably supported by bearings 22*a* and 22*b*, which are fixed to the inner face of the case 10. More specifically, the right end of cylinder 20, i.e., the suction-side end, is rotatably fitted onto the outer circumference of the bearing 22*a*, while the left end of the cylinder, i.e., the discharge-side end, is rotatably fitted onto the outer circumference of the bearing 22*b*. Therefore, the cylinder 20 and the rotor 18 fixed thereto are supported by the bearings 22*a* and 22 *b* to be coaxial with the stator 16.

A columnar rotating rod 24, having a diameter smaller than the inner diameter of the cylinder 20, is arranged in the cylinder 20, extending in the axial direction thereof. The center axis A of the rod 24 is shifted from the center axis B of the cylinder 20 by a distance e, and a part of the outer circumference of the rod 24 is in contact with the inner circumference of cylinder 20. The rotating rod 24 is rotatably supported at both ends thereof by the bearings 22*a* and 22*b*.

As shown in FIGS. 1 and 4, an engaging groove 26 is formed on the outer circumference of the suction-side end of the rotating rod 24, and a drive pin 28, which projects from the inner circumference of the cylinder 20, is fitted in the engaging groove 26 to be movable in the radial direction of the cylinder 20. When the motor section 12 is energized to rotate the cylinder 20 together with the rotor 18, therefore, the rotating force of the cylinder 20 is transmitted to the rotating rod 24 through the drive pin 28. As a result, the rod 24 can be rotated in the cylinder 20, keeping a part of the outer circumference thereof in contact with the inner circumference of the cylinder 20.

Figure 2:
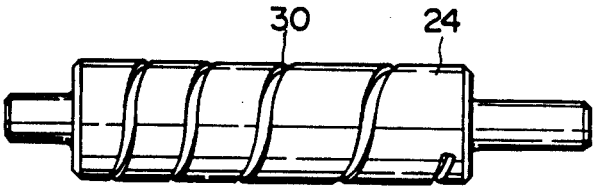

As shown in FIGS. 1 and 2, a spiral groove 30 is formed on the outer circumference of the rod 24, extending between both ends of the rod. As is apparent from FIG. 2, the groove 30, except for its enlarging section which will be described later, is formed in such a manner that its pitches become narrower at a fixed rate with distance from the right end of the cylinder 20 to the left end thereof, that is, with a distance from the suction-side end to the discharge-side end of the cylinder 20. It is preferable that the number of turns of the groove 30 is within the range of four to seven. In the case of this embodiment, the groove 30 has four turns.

Figure 3:
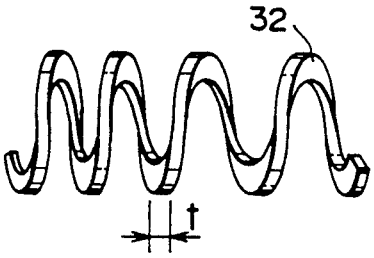

A spiral blade 32 shown in FIG. 3 is fitted into the groove 30. This blade 32 is made of an elastic material, such as Teflon (trademark), and can be fitted into the groove 30 by utilizing its elasticity. Thickness t of the blade 32 is substantially equal to the width of the groove 30. Each portion of the blade 32 is elastically deformed along the shape of the groove 30 and is movable in the radial direction of the rod 24 along the groove. The outer circumferential surface of the blade 32 slides on the inner circumference of the cylinder 20 in tight contact therewith.

As shown in FIGS. 1 and 4, the space between the inner circumference of the cylinder 20 and the outer circumference of the rod 24 is partitioned into a plurality of operation chambers 34 by the blade 32. Each of the operation chambers 34 is defined by two adjacent turns of the blade 32, and is substantially in the from of a crescent extending along the blade 32 from a contact portion between the rod 24 and the inner circumference of the cylinder 20, to the next contact portion. The volumes of the operation chambers 34 are reduced gradually with a distance from the suction-side end to the discharge-side end of the cylinder 20.

As shown in FIGS. 1 and 4, a suction hole 36 extends in the axial direction of the cylinder 20 through the bearing 22*a*, which supports the suction-side end of the cylinder 20. One end of the suction hole 36 communicates with the interior of the cylinder 20 while the other end thereof is connected to a suction tube 38 of the refrigeration cycle. A discharge hole 40 is formed in the bearing 22*b*, which supports the discharge-side end of the cylinder 20, extending in the axial direction of the cylinder 20. One end of this discharge hole 40 communicates with the interior of the cylinder 20, while the other end thereof opens to the inside of the case 10. A discharge hole 40 may be formed in the cylinder 20. A pressure introducing passage 42 is formed in the rod 24, extending from the left end of the rod 24 to close to the right end thereof. The left end of the passage 42 communicates with the inside, particularly the bottom inside of the case 10 through another passage 44 formed in the bearing 22*b*. The right end of the passage 42 opens to the bottom of the groove 30 formed on the rod 24. Lubricating oil 41 collects in the bottom of the case 10. When the pressure in the case 10 increases, therefore, oil 41 is introduced into the space between the bottom of the groove 30 and the blade 32, passing through the passages 44 and 42.

Reference numeral 46 in FIG. 1 denotes a discharge tube which communicates with the inside of the case 10.

The shape of the spiral groove 30 and operating chambers 34 will be described in detail.

Figure 6:
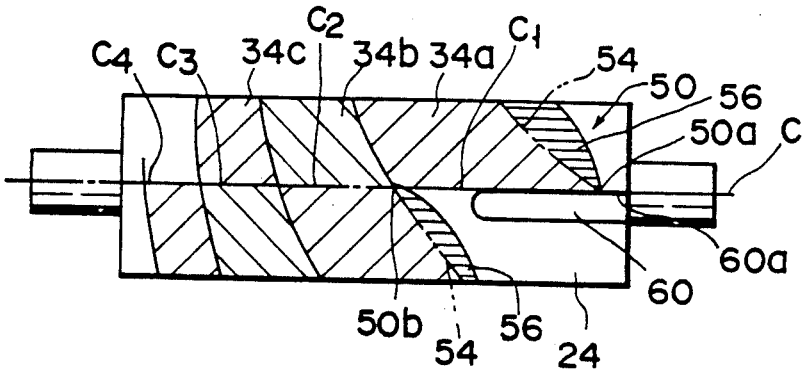

As shown in FIG. 6, the spiral groove 30 extends from the right end of the rotating rod 24 to the left end thereof and has four turns. Therefore, three operation chambers 34*a*, 34*b* and 34*c* are defined by the blade 32 fitted into the groove 30. A dot and dash line C in FIG. 6 denotes the contact portion between the outer circumference of the rotating rod 24 and the inner circumference of the cylinder 20. The operating chambers 34*a*, 34*b*, and 34*c* are partitioned by lines $C_1$, $C_2$, $C_3$ and $C_4$, respectively.

Figure 8:
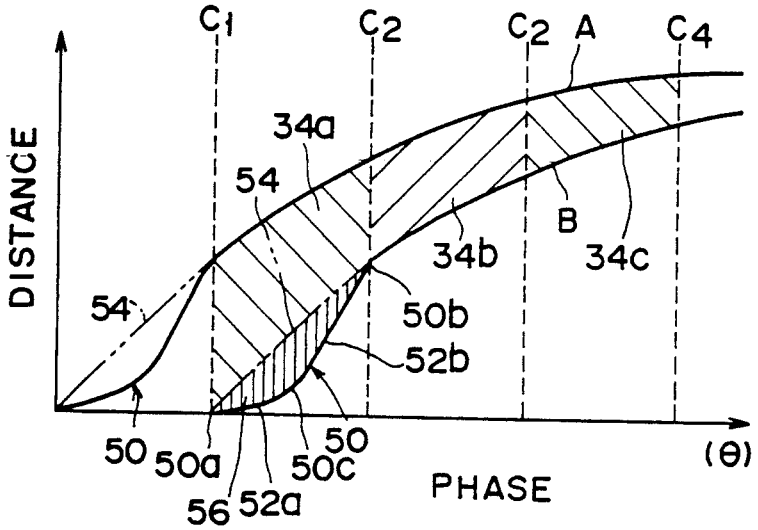

As shown in FIG. 8, the groove 30 is formed on the rod 24 such that the volumes of the operation chambers 34*a* to 34*c* are reduced gradually. In FIG. 8, the axis of ordinate represents a distance from the right end of the rod 24 to the groove 30 in the axial direction of the rod 24, while the axis of abscissa denotes the phase of the groove 30 advancing along the outer circumference of the rod 24. Each of lines A and B in FIG. 8 denotes changes in the pitches of the groove 30, and line B is indicated while its phase advances by 360 degrees with respect to line A. Hatched portions in FIGS. 6 and 8 denote areas of the operation chambers 34, but they will be regarded as representing volumes of the operation chambers in the description which will be made below.

As shown in FIGS. 6 and 8, the groove 30, except for its first turn, is formed in such a way that its pitches decrease at a fixed rate as with a distance the suction-side end of the cylinder 20. The first turn of the groove 30 forms an enlarging section 50 of the present invention. This enlarging section 50 has a start point 50*a* which coincides with the start point of the first turn, a terminal point 50*b* which coincides with the terminal end of the first turn, and a changeover point 50*c* positioned between the start and the terminal point. A first portion 52*a*, extending from the start point 50*a* to the changeover point 50*c*, has a pitch which decreases at a rate smaller that the above-mentioned fixed rate. A second portion 52*b*, extending from the changeover point 50*c* to the terminal point 50*b*, has a pitch which changes at a rate larger than the fixed rate. The two-dot and dash line 54 in FIGS. 6 and 8 denotes the first turn of the groove in a case where the pitches of the groove 30 is reduced at the above fixed rate from its start end to its terminal end. When the groove 30 is provided with the enlarging section 50, the volume of the first operation chamber 34*a* can be increased by the volume of the area 56 enclosed by the line 54 and enlarging section 50, as apparent from FIGS. 6 and 8, compared with the case where the pitches of the groove 30 is changed at the fixed rate.

When the volume of the first operation chamber 34*a* is represented by Vi, and that of the third operation chamber 34*c* by Vo, the compression rate of the compressor is determined by the ratio Vo/Vi of these volumes. On the other hand, in the refrigeration cycle into which the compressor is incorporated, it is required that suction pressure of the refrigerant gas in the suction hole 36 and discharge pressure of the refrigerant gas in the discharge hole 40 are set to within a predetermined range. When the suction pressure is denoted by Pi and the discharge pressure by Po, it is required that ratio Po/Pi of these pressures is within a range of 3–12, depending upon the types of refrigerant and refrigeration cycle used. In order to obtain the desired pressure ratio Po/Pi, it is required that the compression rate of the compressor coincides with this pressure ratio. For this purpose, the operation chambers 34*a* and 34*c* are formed so that their volume ratio Vo/Vi is in the range of 3–12.

Figure 7:
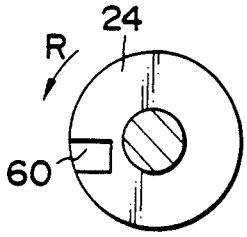

As shown in FIGS. 6 and 7, an introduction groove 60 is formed on the outer circumference of the rotating rod 24, extending along the axis of the rod 24 from the suction-side end of the rod 24 toward the discharge-side end thereof. The groove 60 is deeper than the groove 30 and extends under the blade 32. Refrigerant gas sucked into the cylinder 20 is introduced into the first operation chamber 34*a* through the introduction groove 60. When the rotating direction of the rod 24 is represented by R, the start end of the first operation chamber 34*a* is defined by an end rim 60*a* of the introduction groove 60, therefore, the volume of the operation chamber 34*a* can be optionally set by adjusting the position of the introduction groove 60. The volumes of the operation chambers 34*a* and 34*b* are fundamentally determined by the pitch of the groove 30 when the compressor is designed. However, by adjusting the position of the introduction groove 60, in order to adjust the volume of the first operation chamber 34*a*, the volume ratio Vo/Vi of these operation chambers can be set at a desired value, according to the pressure ratio Po/Pi required for the refrigeration cycle.

Figure 9A:
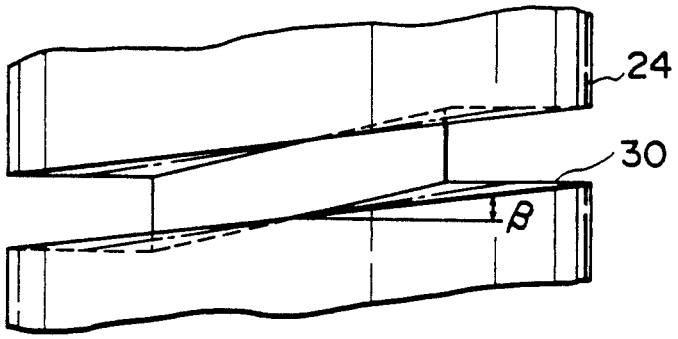
FIGS. 9A through 9C are plan views showing different parts of the spiral groove enlarged.
Figure 9B:
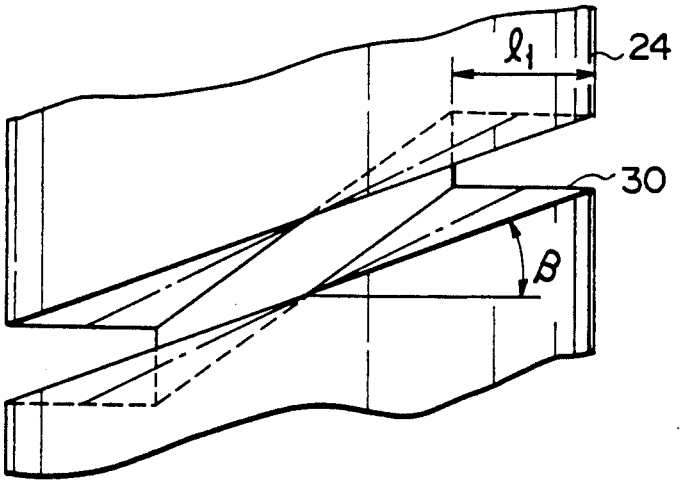
Figure 9C:
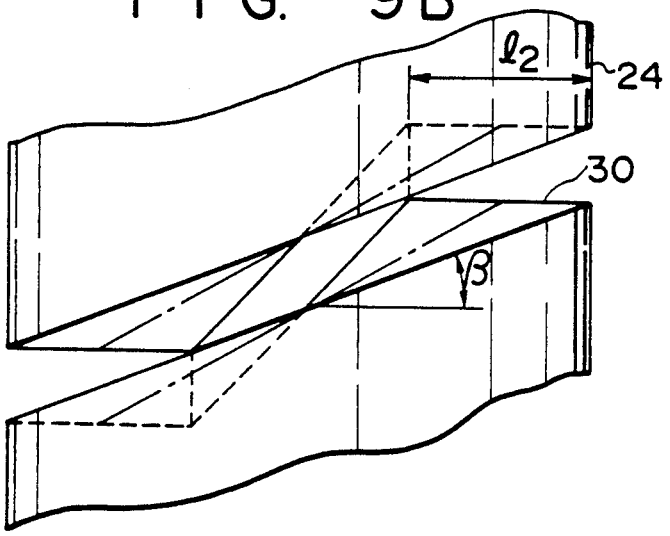
Figure 10A:
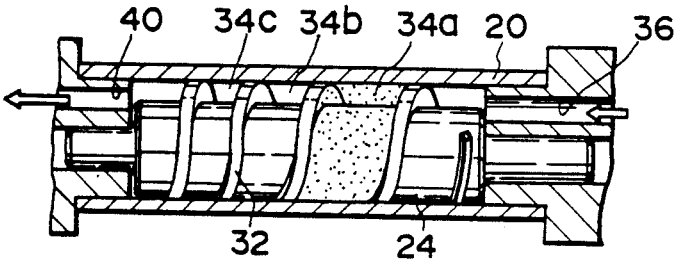
FIGS. 10A through 10D are sectional side views showing respectively compression processes for refrigerant gas.
Figure 11A:
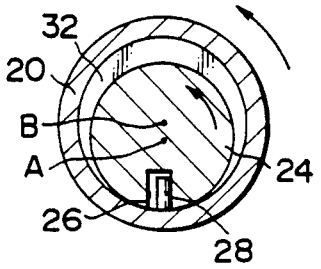
Figure 10B:
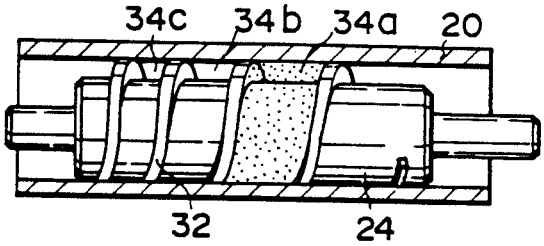
Figure 11B:
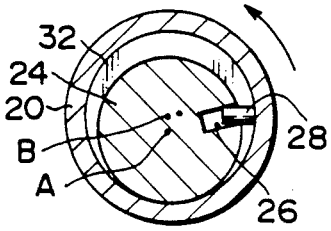
Figure 10C:
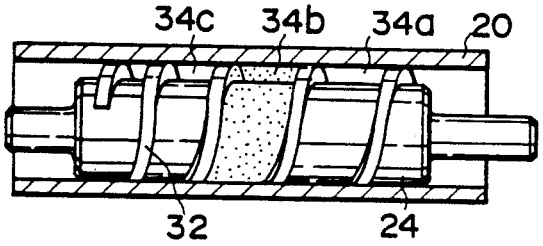
Figure 11C:
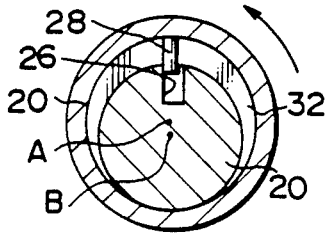
Figure 10D:
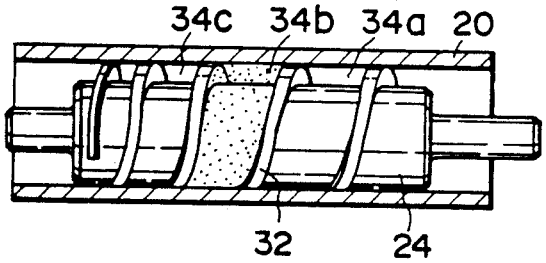
Figure 11D:
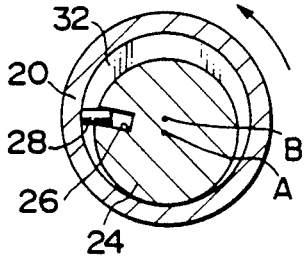

The spiral groove 30 has pitches which are narrowed with a distance from the discharge-side end of the cylinder 20. In this case, the tilted or lead angle $\beta$ the portion, shown in FIG. 9B, of the groove 30 which is positioned on the suction side of the cylinder 20, is larger than the lead angle $\beta$ of the portion, shown in FIG. 9A, the groove 30 which is positioned on the discharge side thereof. Therefore, in the portion of the groove 30 which is located on the suction side, the deformation of the blade 32 must be made large to enable the blade 32 to move in the groove 30 in the radial direction of the rod 24. When the deformation is large, friction between the groove 30 and the blade 32 increases, thereby hindering the blade 32 from moving smoothly in the groove 30. Clearance is thus created between the blade 32 and the cylinder 20, which causes a gas leak. When the depth $l_2$ of the groove 30 shown in FIG. 9C is larger than the depth $l_1$ of the groove 30 shown in FIG. 9B, although the lead angles $\beta$ of these groove portions are the same, the deformation of the blade 32 is more larger. This also makes it more liable for the blade 32 to be hindered from moving smoothly in the groove 30.

According to this embodiment, therefore, the groove 30 is formed in such a manner that the clearance between the groove 30 and the blade 32 becomes larger as the lead angle and depth of the groove 30 become larger. This can reduce the wrong movement of the blade 32 in the groove 30, even on the suction side of the cylinder 20. Since, the lead angle $\beta$ of the groove 30 is made larger on the suction-side or low pressure side of the cylinder 20, if the clearance between the groove 30 and the blade 32 appropriately set, the occurrence of a gas leak can be prevented.

The operation of the compressor having the above-described arrangement will be described.

When the motor section 12 is energized, the rotor 18 and the cylinder 20 are rotated together. The rotating rod 24 is rotated at the same time, keeping a part of its outer circumference in contact with the inner circumference of the cylinder 20. These relative rotations of the rod 24 and the cylinder 20 can be guaranteed by regulation means, which includes the pin 28 and engaging groove 26. The blade 32 is also rotated together with the rod 24.

The blade 32 is rotated with its outer circumference in contact with the inner circumference of the cylinder 20. Therefore, each part of the blade 32 is formed into the groove 30 as it approaches each contact portion between the outer circumference of the rod 24 and the inner circumference of the cylinder 20, while it emerges from the groove 30 as it goes away from the contact portion. When the compressing section 14 is operated, refrigerant gas is sucked into the cylinder 20, passing through the suction tube 38 and the hole 36. This gas passes through the introduction groove 60 and is then isolated in the first operation chamber 34*a* which is nearest to the suction-side end of the cylinder 20. As the rod 24 is rotated, the gas is fed into the second and third operation chambers 34*b* and 34*c* successively, while it is isolated between each two adjacent turns of the blade 32, as shown in FIGS. 10A to 10D. The volumes of the operation chambers 34 are reduced gradually with a distance from the suction-side end of the cylinder 20. Thus, the refrigerant gas is gradually compressed while being fed towards the discharge side of the cylinder 20. The compressed gas is discharged into the case 10 through the discharge hole 40 in the bearing 22b and then returned into the refrigeration cycle through the discharge tube 46. The position of the rotating rod 24 relative to the cylinder 20 changes, as shown in FIGS. 11A through 11D, during the compression process.

According to the compressor having the above-described arrangement, the pitches of groove 30 become gradually narrower with a distance from the suction side of the cylinder 20. In other words, the volumes of the operation chambers 34, partitioned by the blade 32, become gradually smaller with a distance from the suction side of the cylinder 20. The refrigerant gas can be thus compressed while it is being fed from the suction side of the cylinder to the discharge side thereof through the operation chambers 34. Further, the gas is fed and compressed under the condition that it is isolated in the operation chambers 34. Even when no discharge valve is arranged on the discharge side of the compressor, therefore, it can be compressed with higher efficiency.

The compressor can be made simpler in construction with a smaller number of components, because the discharge valve can be omitted. In addition, the rotor 18 of the motor section 12 is supported by the cylinder 20 of the compressing section 14. This makes it unnecessary to use an exclusive rotating shaft and bearings for supporting the rotor 18. Therefore, the compressor can be made far simpler in construction and the number of components used can be reduced.

The cylinder 20 and the rotating rod 24 are in contact with each other while they are being rotated in the same direction. Thus, the friction between these components is so small that they can rotate smoothly with less vibration and noise.

The feeding capacity of the compressor depends on the first pitch of the blade 32, that is, the volume of the first operation chamber 34a, positioned at the suction-side end of the cylinder 20. In this embodiment, the first turn of the spiral groove 30 forms the enlarging section 50. Therefore, the volume or discharge volume of the first operation chamber 34a can be made larger as compared with the case where the pitches of the groove 30 decreases at a fixed rate from the start end of the groove 30 to the terminal end thereof. The discharge volume of the compressor can thus be increased as compared with other compressors having a rotating rod and spiral groove the same in length as, and a spiral groove with the same number of turns as, those of the compressor of this embodiment. As a result, a compressor capable of compressing a larger volume of fluid, but which is not over-sized and which enhances the capacity of the refrigerating cycle, is achieved.

The compression ratio of the compressor or volume ratio Vo/Vi of the first and third operation chambers 34a and 34c is set within the range of 3–12, according to the range of the pressure ratio Po/Pi needed by the refrigeration cycle into which the compressor is incorporated. Thus, refrigerant gas compressed by the compressor can be smoothly discharged into the refrigeration cycle without causing any change in pressure. Namely, neither excessive compression nor inadequate compression is caused, and the refrigerant gas can be compressed at a compression rate suitable for the refrigeration cycle. The compression capacity of the compressor can be freely changed within a certain range, by changing the position of the introduction groove 60 on the rotating rod 24 so as to change the volume of the first operation chamber 34a. Therefore, the compression capacity of the compressor can be adjusted to the specification (or needs) of the refrigeration cycle into which the compressor is to be incorporated, in the course of manufacturing or assembling the compressor, which means that a compressor with a variable capacity can be provided.

Further, the blade 32 of the compressor has four turns and two at a minimum, or three as in the case of this embodiment, operation chambers are formed. The volumes of the operation chambers become gradually smaller, so that the refrigerant gas is gradually compressed while passing through these operation chambers. It is required that the rotating rod 24 and the cylinder 20 are rotated three times to finish one compression process. When three operation chambers are formed to extend the compression process like this, the pressure difference of the refrigerant gas in each adjacent operation chamber can be made relatively small and the change in the pressure acting on the blade 32 can also be relatively minimized. In addition, the load added to the motor section 12 to rotate the rod 24 and the cylinder 20 per each revolution can be reduced.

In a case where the number of blade turns is smaller than four, for example, two, a maximum of two, or possibly only one operation chamber can be formed. The pressure difference of refrigerant gas in the adjacent operation chambers is large and the pressure acting on the blade changes to some great extent in this case. Thus, the pressure is locally applied onto a part of the blade and the blade is thus deformed, allowing refrigerant gas to leak. Further, it is required that one compression process is finished during the rod 24 and the cylinder 20 are rotated once or twice, so that a large load is applied to the motor section and the large motor section must be used.

According to this embodiment of the present invention, refrigerant gas can be more smoothly compressed without causing any large change in pressure, as compared with the case where the blade has three or less turns. As a result, the occurrence of gas leakage can be reduced. At the same time, the drive torque needed for the motor section 12 can be reduced and more efficient compression can be achieved by a small-sized motor section. Further, the life of the blade can be extended because changes in the pressure acting on the blade can be reduced.

Even when the number of blade turns around the rod is not four but five or more, the same merits as those of this embodiment can be attained. However, the required advantages can only be attained if no more than five operation chambers are provided. When the number of the operation chambers formed is more than five, the friction loss between the blade 32 and the spiral groove 30 is increased. The drive torque needed for the motor section 12 is thus increased and no rise of compression efficiency can be expected. In short, the above-mentioned demerits are caused when the number of blade turns is more than seven. Therefore, in order to maximize the effects of making the compressor small and light, and raising the compression efficiency thereof, the optimum number of turns of the blade 32 is in the range of 4–7.

It should be understood that the present invention is not limited to the above-described embodiment, and that various changes and modifications can be made in the scope of the present invention.

Figure 12:
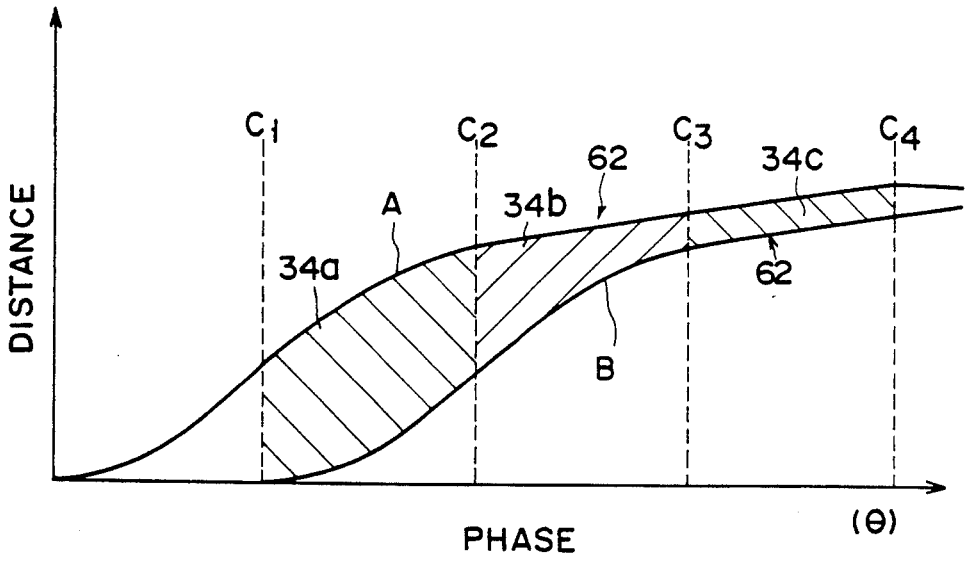
FIG. 12 is a graph showing the relation between a modified spiral groove and the volume of operation chambers.

As shown in FIG. 12, for example, the spiral groove 30 may have turns 62 which have the same pitch. These same-pitch turns 62 are inclined at a predetermined angle with respect to the axis of the rotating rod 24. When these turn 62 are provided, the rate of change in the pressure of refrigerant gas, compressed in the operation chambers, can be adjusted.

Although the enlarging section 50 of the groove 30 is formed by the first turns of the groove 30 in the above-described embodiment, the whole length of this enlarging section 50 may be made longer or shorter than that of the first turns of the groove 30. The compression capacity of the compressor can be easily adjusted by changing the whole length of the enlarging section 50.

Figure 13:
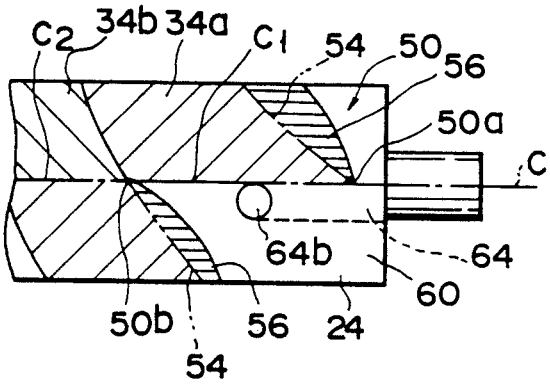
FIGS. 13 and 14 are plan and side views showing a modified rotating rod.
Figure 14:
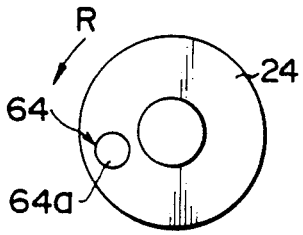

As shown in FIGS. 13 and 14, an introduction hole 64 may be provided instead of the introduction groove for introducing refrigerant gas into the first operation chamber 34*a*. The introduction hole 64 is formed in the rotating rod 24, extending in the axial direction of the rod 24, and it has an introduction opening 64*a* at the end face of the rod 24 positioned on the suction side of the cylinder 20, and a discharge opening 64*b* at the outer circumference of the rod 24. The start end of the first operation chamber 34*a* is defined by the end rim of the discharge opening 64*b* positioned upstream in the rotating direction R of the rod 24. When this introduction hole 64 is employed, the volume of the first operation chamber or discharge volume of the compressor can be adjusted, as seen in the case of the above-described embodiment, by changing the position of the discharge opening 64*b*.

The present invention can be applied to compressors other than those used in refrigeration cycles.

What is claimed is:

1. A fluid compressor comprising:

a cylinder having a suction-side end and a discharge-side end;

a columnar rotating body arranged in the cylinder to extend in the axial direction of the cylinder and eccentric thereto, and rotatable relative to the cylinder while part of the rotating body is in contact with the inner circumferential surface of the cylinder, said rotating body having a spiral groove formed on its outer circumference, said groove having pitches narrowed at a predetermined rate with a distance from the suction-side end of the cylinder to the discharge-side end thereof and having an enlarging section provided with start, changeover and terminal points, and said enlarging section including a first portion extending from the start point to the changeover point and having a pitch which changes at a rate smaller than said predetermined rate, and a second portion extending from the changeover point to the terminal point and having a pitch which changes at a rate larger than said predetermined rate;

a spiral blade fitted into the groove to be slidable in the radial direction of the cylinder, having an outer circumference in close contact with the inner circumference of the cylinder, and dividing the space between the inner circumference of the cylinder and the outer circumference of the rotating body into a plurality of operation chambers; and drive means for relatively rotating the cylinder and the rotating body to successively feed a fluid, introduced from the suction-side end of the cylinder into the cylinder, toward the discharge-side end of the cylinder through the operation chambers, and discharge the fluid out through the discharge-side end of the cylinder.

2. The compressor according to claim 1, wherein said spiral groove has a plurality of turns, including a first turn adjacent to the suction-side end of the cylinder, and the start point of said enlarging section coincides with a start end of the first turn of said groove.

3. The compressor according to claim 2, wherein said terminal point of the enlarging section coincides with a terminal end of the first turn of said groove.

4. The compressor according to claim 1, wherein said spiral groove has at least four turns, and at least two operation chambers are defined in the cylinder.

5. The compressor according to claim 4, wherein said spiral groove has a number of turns which is in a range of four to seven.

6. The compressor according to claim 1, wherein said spiral groove has turns which have the same pitch, said same-pitch turns being located nearer to the discharge-side end of the cylinder than the enlarging section.

7. The compressor according to claim 1, wherein said operation chambers include a first operation chamber positioned on the suction-side of the cylinder and a final operation chamber positioned on the discharge-side of the cylinder, and the volume of said first operation chamber is set three to twelve times the volume of said final operation chamber.

8. The compressor according to claim 7, wherein said rotating body has an introduction groove formed on its outer circumference to introduce a fluid, fed through the suction-side end of the cylinder, into the first operation chamber, and said introduction groove having an end opened at that end face of said rotating body which is positioned on the suction-side end of the cylinder, and a rim extending along the axis of said rotating body and defining a suction-side border of said first operation chamber.

9. The compressor according to claim 7, wherein said rotating body has a introduction hole for introducing a fluid, fed through the suction-side end of said cylinder, into the first operation chamber, and said introduction hole including an introduction opening opened at that end face of said rotating body which is positioned on the suction side of said cylinder, and a discharge opening opened at the outer circumference of said rotating body, to define a suction-side border of said first operation chamber.

10. The compressor according to claim 1, wherein said blade is fitted into the spiral groove with a gap therebetween, and said gap becomes smaller as the pitches of said groove decrease.

* * * * *